United States Patent [19]

Kugler

[11] 4,036,363

[45] July 19, 1977

[54] AUTOMATIC FILLING OF BAGS

[75] Inventor: Robert J. Kugler, East Meadow, N.Y.

[73] Assignee: Action Packaging Corporation, Brooklyn, N.Y.

[21] Appl. No.: 674,872

[22] Filed: Apr. 8, 1976

Related U.S. Application Data

[63] Continuation-in-part of Ser. No. 434,377, Jan. 18, 1974, abandoned, which is a continuation of Ser. No. 274,509, July 24, 1972, abandoned.

[51] Int. Cl.[2] ..... B65D 85/54; B65D 33/28

[52] U.S. Cl. ..... 206/526; 150/7; 150/11; 206/554; 229/63

[58] Field of Search ..... 150/3, 7, 11; 229/63; 206/801, 526

[56] References Cited

U.S. PATENT DOCUMENTS

| | | | |
|---|---|---|---|
| 254,440 | 2/1882 | Kurtz | 150/11 |
| 1,261,846 | 4/1918 | Osgood | 150/11 |
| 2,616,467 | 11/1952 | Cicero | 150/11 X |
| 2,635,664 | 4/1953 | Cohen | 150/11 X |
| 2,799,611 | 7/1957 | Dreisbach | 229/63 X |
| 3,100,569 | 8/1963 | White | 206/801 X |
| 3,119,549 | 1/1964 | Schoen | 229/63 |
| 3,385,428 | 5/1968 | Kugler | 206/801 X |
| 3,653,583 | 4/1972 | Meyer | 150/11 X |
| Re. 7735 | 6/1877 | Redden | 150/7 |

*Primary Examiner*—Stephen P. Garbe
*Attorney, Agent, or Firm*—Amster & Rothstein

[57] ABSTRACT

A bag, having a top opening and a draw cord arrangement adapted to close the top opening, is provided with a dust ruffle, which is secured inside the bag and extends upward and through the top opening. By this arrangement, the dust ruffle shirrs the top opening when the bag is closed, thereby inhibiting the entry of particulate matter. The dust ruffle is provided with a pair of holes, so that a plurality of bags can be formed into a bag-pack for use on automatic filling equipment by stacking the bags, with the dust ruffle holes aligned, and inserting the rods of a bag-holder into the stack of bags to retain them as a unit. In one embodiment, the bag-holder is inserted from the rear of the stack of bags to form a bag-pack. The bag-pack is then loaded onto an automatic filling machine provided with a pair of hollow, parallel, generally horizontal rails by inserting the rails into the dust ruffle holes and allowing the bag-holder rods to enter the rails. By this arrangement, the stack of bags is supported in a generally vertical position and the bags are filled and removed from the front of the stack, with the stack being advanced along the rails as bags are filled. When the supply of bags on the rails is low, additional bags are added without stopping the machine by removing the bag-holder from the rails and loading a new bag-pack behind the bags remaining on the rails.

4 Claims, 7 Drawing Figures

AUTOMATIC FILLING OF BAGS

This is a continuation-in-part of application Ser. No. 434,377, filed Jan. 18, 1974 and now abandoned which was a continuation of application Ser. No. 274,509 filed July 24, 1972 and now abandoned.

This invention relates generally to automatic filling of bags and in particular to bags having a dust ruffle or shirr strip to inhibit the passage of small particulate matter into the bag, which dust ruffle is constructed to facilitate automatic filling of the bags.

Many types of bags used for packaging commodities, such as produce and ice, are known to the art. A typical bag is disclosed in U.S. Pat. No. 3,119,549.

Bags commonly used are equipped with draw cords for closing the open end of the bag. Unfortunately, these draw cords have not been sufficient to close the bag tightly enough to inhibit or prevent the passage of small particulate matter, such as dust or the like, through the opening and into the bag. One solution to the problem was to seal the top of the bag after the bag had been filled. The seal prevented the passage of dust, but once the bag was opened, there was no means for inhibiting the passage of dust when the consumer reused the bag. With the advent of an increased ecological concern on the part of the consumer and the public in general, it has become necessary to invent a bag which, through repeated uses, protects the contents of the bag from contamination with dust or the like.

Commercial users of bags equipped with draw cords have suffered the additional inconvenience of having to fill such bags manually, rather than using available automatic bag-filling equipment. The cords on these bags make them substantially thicker than bags without cords. As a result, when such bags are formed into stacks and placed into the bag-holding compartments of conventional automatic filling machinery, a relatively small number of bags can be fitted into the storage compartment. With the fast operating speed of modern bag filling equipment, these bags are quickly used up and it becomes necessary to stop the machine in order to replenish the bag supply. Such interruptions for adding bags are very frequent and the time lost in stopping and reloading the machine makes automatic filling as slow as, or slower than, manual filling.

It is an object of this invention to inhibit the passage of small particulate matter into a bag equipped with a draw cord closure means.

It is another object of this invention to provide a bag of the type having draw cord closure means, which bag is constructed to inhibit the passage of small particulate matter into the bag when it is closed.

It is another object of this invention to provide bags including draw cord closure means, which bags are conveniently formed into a bag-pack for use on automatic bag filling equipment.

It is another object of this invention to provide a bag including draw cord closure means and constructed to inhibit the passage of dust into it, which bag is simple and economical in construction, yet permits efficient filling by automatic equipment, and is reliable in use.

It is a further object of this invention to fill bags including draw cord closure means on automatic bag filling equipment without having to stop the equipment repeatedly to provide additional bags.

In accordance with an illustrative embodiment demonstrating objects and features of the present invention, a bag including front and back walls, draw cord closure means, and an open top is provided with a dust ruffle. The dust ruffle is secured to the inside surface of one of the walls near the open top of the bag, and extends upward and through the open top. The dust ruffle is effective to inhibit the entry of dust into the bag when the draw cords are operated to close the bag. The dust ruffle has a pair of holes in it, and when a stack of bags is formed, the holes in different dust ruffles are aligned. A bag-holder, including a pair of rods, arranged to enter the aligned holes in the dust ruffles, is applied from the rear through a stack of bags to form a bag-pack, which can be handled as a unit and is conveniently loaded into automatic bag filling equipment.

In order to mount a bag-pack in an automatic bag filling machine, a pair of hollow, parallel rails are provided which are supported on the machine with their front ends at the loading end of the machine. The rails extend generally horizontally and backwards. The bag-pack is mounted by inserting the rods of the holder into the rails and pushing the bag-pack forward to force the rails into the holes in the bag dust ruffles. After the bag-pack is mounted, the bags are supported in a generally vertical position. As bags are automatically filled and removed from the pack near the front of the rails, the bags are moved forward by applying a force to the rearmost bag. When a small number of bags remain on the rails, the holder may be withdrawn and replaced with a new bag-pack, which is mounted behind the remaining bags, as described above, without stopping the machine. Thus, the machine may be operated continuously without stopping to replenish bags.

The foregoing brief description as well as further objects, features and advantages of the present invention are best understood by reading the following detailed description of presently preferred, but, nonetheless, illustrative embodiments of the present invention while referring to the drawings, in which.

Figure 7:
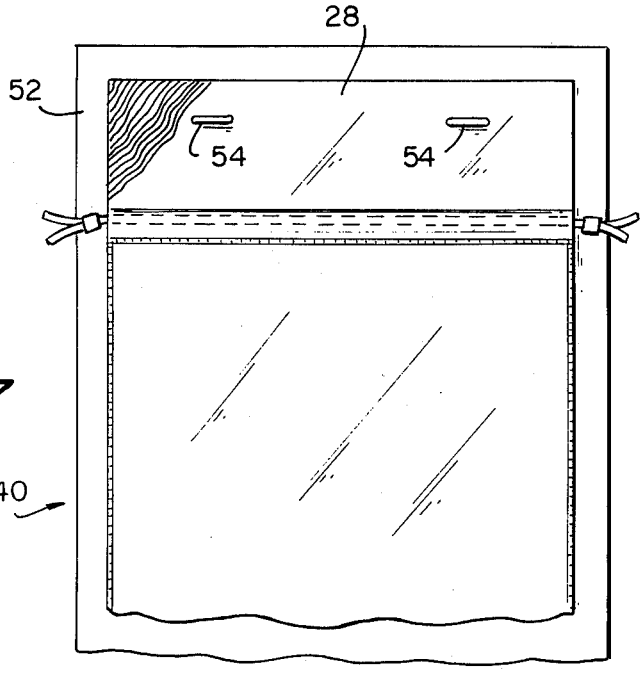
Figure 6:
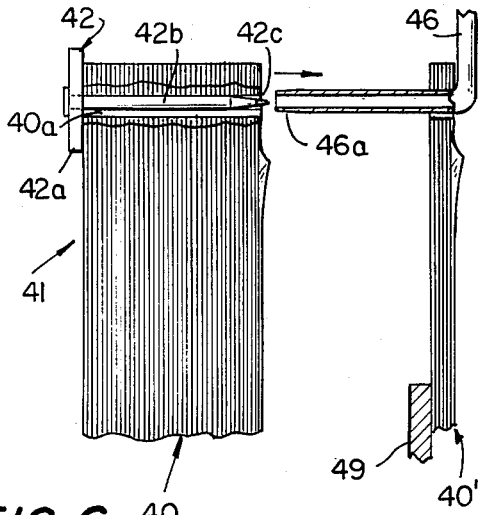

FIG. 6 is a sectional view, with parts broken away, showing how a new bag-pack is loaded on the supporting rails when only a few bags from an old bag-pack are left on the rails; and FIG. 7 is a plan view, with parts broken away, showing an alternate arrangement for forming a bag-pack, the bag-pack being formed by driving staples through the dust ruffles in the stacked bags and into a backing board.

Figure 1:
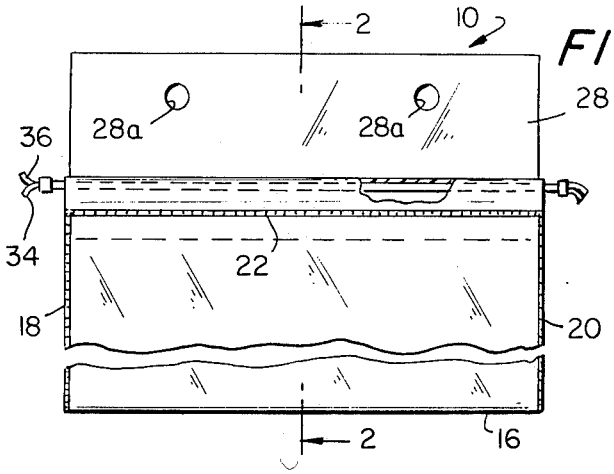
FIG. 1 is a plan view, with parts broken away, showing a bag having draw cord closure means and a dust ruffle including holes therein for forming a bag-pack.
Figure 2:
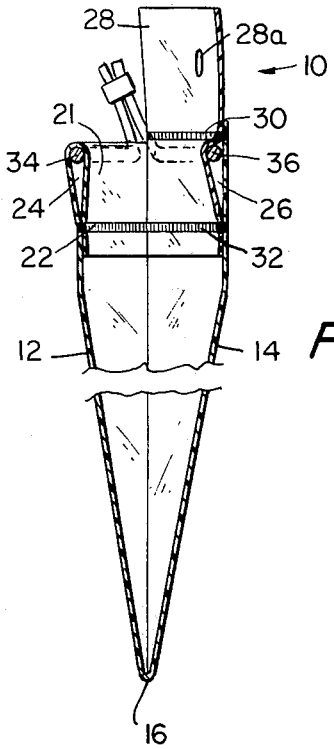
FIG. 2 is a sectional view of a bag taken along the line 2—2 of FIG. 1 and shows the detailed construction of the bag and dust ruffle, the dust ruffle being secured to one of the walls of the bag to form a passageway for one of the draw cords.

Referring now to the details of the drawings, there is shown in FIGS. 1 and 2 a bag 10 having a front wall 12 and a rear wall 14 joined together along a bottom fold line 16. The bag also includes side seams 18 and 20, along which the walls 12, 14 are joined by heat-sealing, adhesives, or the like, leaving the top 21 of the bag open. Front wall 12 is hemmed at the top, for example, by means of a heat seal 22 extending across wall 12, to form a passageway 24. Another passageway 26 is formed by attaching a strip of sheet material 28 at the top of rear wall 14, for example, by means of heat seals 30 and 32 extending across wall 14. The strip 28 also extends upwards, through the opening 21 at the top of bag 10 and substantially above it, to form a shirr strip or dust ruffle for the bag. The dust ruffle 28 includes holes **28*a*, 28*a* which facilitate stacking bags for automatic filling, as will be more fully discussed hereinafter. Draw cords 34, 36, extending through passageways 24 and 26, respectively, are provided for closing the top of bag 10 and are joined at their ends by any conventional means, such as metal clips. When the top of bag 10 is closed by operating draw cords 34, 36, the dust ruffle 28** inhibits the passage of dust into the bag.

Figure 3:
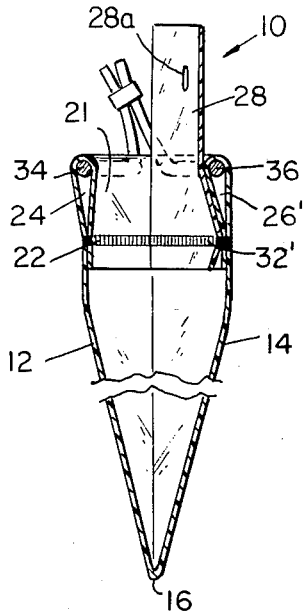
FIG. 3 is a sectional view of a bag depicting an alternate construction for the bag and dust ruffle, in which both draw cords are enclosed in passageways formed by hems in the bag walls.

FIG. 3 depicts the cross-section of an alternate form of bag useful in the invention. This bag is nearly identical to the bag of FIGS. 1 and 2, and similar elements have been indicated by the same reference numerals. The major distinction of the embodiment of FIG. 3 is that the draw cord 36 passes through a passageway 26' formed at the top of rear wall 14, for example, by hemming the wall with a heat-seal 32', which heat-seal also serves to secure the strip 28 to rear wall 14. Of course, separate means of attachment may be used for the hem and the strip 28.

The bags and associated dust ruffles illustrated herein may be made of any flexible material, but are preferably made of a thermoplastic material such as polyethylene. The dust ruffle may be made of the same material as the bag, but is preferably made of a thinner material to permit the dust ruffle to form a more compact mass when the bag is closed, and, thereby, better to inhibit the passage of dust into the bag. In the most preferred form, the bags are made of polyethylene, all seams and seals are made by heat-sealing, and the dust ruffle is made of polyethylene which is substantially thinner than the sheet of polyethylene used to make the bag. It is to be emphasized that although the particular bag constructions illustrated here were both top-opening bags, the invention is equally applicable to bottom-opening bags or tubular bags having two open ends.

In order to form an effective dust seal when the bag is closed, dust ruffle 28 must protrude directly toward and through the opening 21 of the bag. It has been found that for the most effective dust sealing, the dust ruffle should extend beyond the opening 21 for a distance of, at least, one-quarter of an inch. Although such a relatively short extension of the dust ruffle is adequate when the bags are filled manually, the holes **28*a* provided to facilitate automatic filling are, preferably, about three-eighths of an inch in diameter, and when such holes are provided in the dust ruffle, it is preferred that the minimum extension of the dust ruffle beyond the opening 21 be approximately 1 inch. This assures that the holes 28*a* are adequately spaced from the edge of the strip 28 and the opening 21** of the bag.

Figure 4:
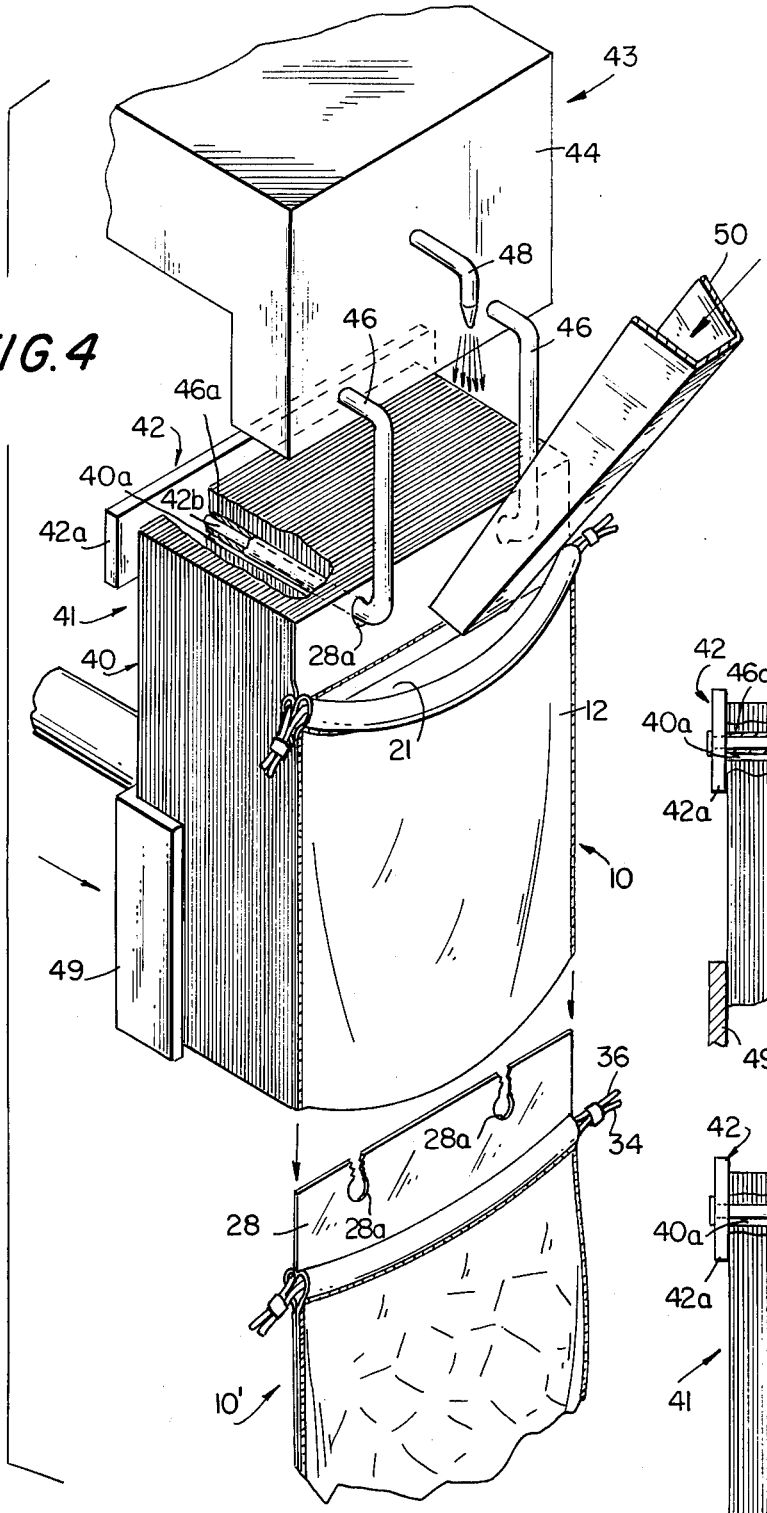
FIG. 4 is a perspective view depicting bags being filled in an automatic machine, and shows portions of the machine, as well as, a bag-pack in its mounted position with the front bag being filled and a previously filled bag being withdrawn.
Figure 5:
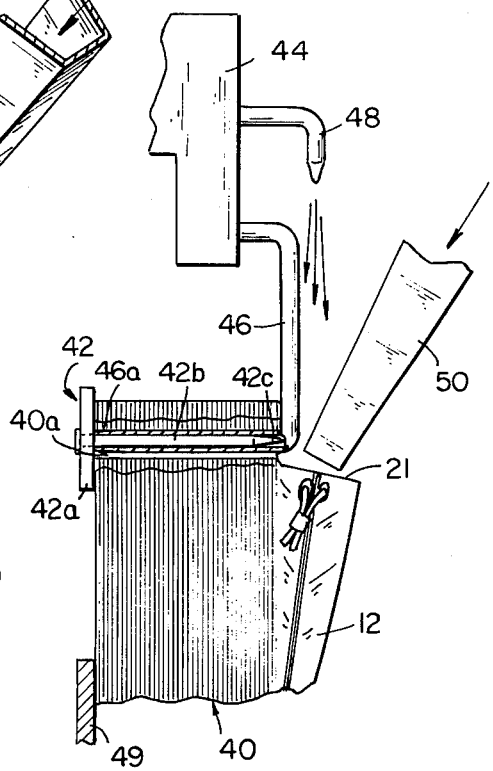
FIG. 5 is a side view of the machine and bag-pack of FIG. 4, with parts broken away and parts in section, showing the details of how the bag-pack is mounted on the supporting rails.

As can be seen in FIGS. 4 through 6, a plurality of bags of the type described hereinbefore are conveniently adapted for use in a machine for automatic filling. For this purpose, the bags are arranged in a stack 40 with the front wall 12 of each bag oriented toward the front of the stack and the bags 10 generally aligned so that the holes **28*a*, 28*a* in the dust ruffles of the stacked bags are aligned to form a pair of channels 40*a*, 40*a* passing through the stack of bags (see FIG. 6). A bag-holder 42 is used with the stack of bags 40 to form a bag-pack 41, which is conveniently handled as a unit for mounting on an automatic filling machine. The bag-holder 42 includes a base 42*a* and a pair of generally parallel rods 42*b*, 42*b* protruding laterally from the base. The rods 42*b*, 42*b* are positioned to be aligned with the channels 40*a*, 40*a* in the stack of bags, and are easily inserted into the channels, as a result of each of the rods 42*b*, 42*b* having a tapered tip 42*c*. The bag-pack 41 is formed by inserting the rods of bag-holder 42 into the stack of bags 40** from the rear. The bag pack is then conveniently handled as a unit for mounting into a machine for automatic filling, as will be more fully explained hereinafter.

Referring now to FIGS. 4, 5, and 6, it is shown how the bag-pack 41 is employed in a machine 43 for automatically filling bags. The machine includes a stationary rigid support member 44 from which there depends a pair of hollow rails 46, 46. The rails 46, 46 extend rearward and under the member 44, in a generally horizontal direction, to form a pair of supports for maintaining the bag-stack 40 in a generally vertical position. A nozzle 48, which projects from member 44 at a point above and between the rails 46, 46, is arranged to selectively direct a blast of air downward between the supporting rails 46, 46. The machine 43 also includes a bag-feeder 49 which is operated by conventional means (not shown), such as a motor, to advance bag-stack 40 towards the front of rails 46, 46. A chute 50, mounted on machine 43 by conventional means (not shown) and coupled to a source (not shown) of the product to be deposited in the bags, is positioned directly over the open top 21 of the front bag of stack 40.

Referring now to FIG. 6, it can be seen how bag-pack 41 is mounted onto the horizontal portion of rails 46, 46. The tapered fronts **42*c*, 42*c* of rods 42*b*, 42*b* are easily located inside the ends of rails 46, 46. Once this is done, pressure is applied to the base 42*a* of holder 42 to force bag-pack 41 forward (as indicated by the arrows), inserting rods 42*b*, 42*b* into rails 46, 46 and simultaneously forcing rails 46, 46 into channels 40*a*, 40*a* in bag-stack 40. The tapered ends 46*a*, 46*a* of rails 46, 46 simplify the insertion of rails 46, 46 into channels 40*a*, 40*a*. Once the rods 42*b*, 42*b* are completely inserted into rail 46, 46**, automatic filling of the bags can begin.

With the bag-stack 40 in position on rails 46, 46 (see FIGS. 4 and 5) bag-feeder 49 forces the bag-stack 40 forward to bring the frontmost bag into position for loading. When the frontmost bag is in position, a blast of air from nozzle 48 causes the bag to be opened up, and chute 50, which is connected to a source of the product to be loaded into the bag, delivers a measured amount of product from the source to the open bag. After filling, the bag is pulled downward by conventional means (not shown), and is removed from the rails 46, 46 by tearing the part of dust ruffle 28 above holes **28*a*, 28*a*. Bag 10' in FIG. 4 represents a bag that has been previously filled and torn away from rails 46, 46. After a bag is torn away, bag-feeder 29 advances bag-stack 40 forward to bring the next bag into position for loading. In a final operation, the loaded bags are closed by operating the draw cords 34, 36**, thereby compressing the dust ruffle 28 to seal out particulate matter, as previously described.

From the foregoing description it will be appreciated that an arrangement including a bag-stack 40 and a holder 42 is readily loaded onto rails 46, 46 while automatic filling is taking place. After a bag-stack is loaded onto rails 46, 46, a bag-feeder 49 repeatedly moves the bag-stack forward as bags are filled and removed. As bag-stack 40 is moved forward along rails 46, 46, the thickness of the bag-stack decreases and, eventually, only a thin stack 40' (see FIG. 6) is left on rails 46, 46. The holder 42, which is mounted in rails 46, 46 by means of rods **42*b*, 42*b*, can then be removed and replaced by a new, complete bag-pack 41, as previously described. As the bag-pack 41 is slid onto rails 46, 46, bag-feeder 49 is momentarily removed from behind bag-stack 40' and is placed behind bag-stack 40 when it is in position on rails 46, 46.** In this manner, automatic bag filling can continue without stopping to reload a new stack of bags each time a stack is used up.

FIG. 7 illustrates an alternate arrangement for forming a bag-pack. According to this arrangement, the bags are formed into a stack 40 with their dust ruffles 28 aligned. The stack is secured to a backing or supporting board 52 by means of a pair of staples 54, 54 which penetrate the bag-stack 40 and are secured in supporting board 52.

Although specific embodiments of the invention have been described for illustrative purposes, it will be apparent to one skilled in the art that many modifications, additions and substitutions are possible without departing from the scope and spirit of the disclosed invention.

What is claimed is:

1. A bag-pack adapted to be loaded into a machine for automatic filling of bags, said bag-pack comprising:

a plurality of bags made of heat-sealable plastic material, each bag having first and second walls joined by heat-sealed seams at the sides of the bag and defining an opening at the top of the bag, said first wall having a hem at the top thereof defining a first passageway open at each end, a strip of plastic protruding directly through said opening and attached to the inside surface at the top of said second wall by two heat-sealed seams extending across said wall from one side to the other, said heat-sealed seams defining a second passageway open at each end, and cord-closure means contained in said first and second passageways and being adapted to draw the top of the bag closed; and means engaging said strips of plastic for retaining said bags in a stack arrangement.

2. The bag-pack of claim 1 wherein said strip of plastic in each of said bags is substantially thinner than the walls of the bag.

3. The bag-pack of claim 1 wherein each strip of plastic has at least one hole therein, said bags being arranged in a stack with corresponding holes in different ones of said strips of plastic aligned to form a channel in said stack of bags, said retaining means further comprising a base, and at least one rod projecting from said base, a different one of said rods corresponding to each channel in said stack of bags, said rods being positioned to be aligned with the corresponding channel and being inserted inside said channel to retain said bags in a stacked condition.

4. A bag made of heat-sealable plastic material having first and second walls joined by heat-sealed seams at the sides of the bag and defining an opening at the top of the bag, said first wall having a hem at the top thereof defining a first passageway open at each end, a strip of plastic protruding directly through said opening and attached to the inside surface at the top of said second wall by two heat-sealed seams which extend across said wall from one side to the other, said heat-sealed seams defining a second passageway open at each end, closure means contained in said first and second passageways and being adapted to draw the top of the bag closed, whereby said strip of plastic shirrs and fills said opening in response to the closing action of said cord-closure means to inhibit the passage of particulate matter through said opening.

* * * * *